US007513930B2

(12) United States Patent
Liebaert

(10) Patent No.: US 7,513,930 B2
(45) Date of Patent: Apr. 7, 2009

(54) REDUCTIVE METHOD FOR PRODUCTION OF METALLIC ELEMENTS SUCH AS CHROME USING A CRUCIBLE WITH A PERFORATED WALL

(75) Inventor: Philippe Liebaert, Rosult (FR)

(73) Assignee: Delachaux S.A., Gennevilliers (FR)

( * ) Notice: Subject to any disclaimer, the term of this patent is extended or adjusted under 35 U.S.C. 154(b) by 430 days.

(21) Appl. No.: 10/502,196

(22) PCT Filed: Jan. 20, 2003

(86) PCT No.: PCT/FR03/00165

§ 371 (c)(1),
(2), (4) Date: Oct. 5, 2004

(87) PCT Pub. No.: WO03/062480

PCT Pub. Date: Jul. 31, 2003

(65) Prior Publication Data

US 2005/0034561 A1 Feb. 17, 2005

(30) Foreign Application Priority Data

Jan. 21, 2002 (FR) ..... 02 00680

(51) Int. Cl.
*B22F 9/22* (2006.01)
*C22B 34/32* (2006.01)

(52) U.S. Cl. ..... 75/363; 75/623

(58) Field of Classification Search ..... 75/363, 75/623

See application file for complete search history.

(56) References Cited

U.S. PATENT DOCUMENTS

| | | | | |
|---|---|---|---|---|
| 3,816,102 | A * | 6/1974 | Celada et al. | 75/387 |
| 4,127,426 | A * | 11/1978 | Nicoud | 419/23 |
| 4,504,310 | A * | 3/1985 | Boulier | 75/623 |
| 5,067,994 | A * | 11/1991 | Brubak et al. | 148/415 |
| 7,144,441 | B2 * | 12/2006 | Huang et al. | 75/335 |

FOREIGN PATENT DOCUMENTS

| | | |
|---|---|---|
| CN | 87 2 03863 U | 5/1988 |
| EP | 0102892 | 3/1984 |
| FR | 2509452 | 1/1983 |
| GB | 2255349 | 11/1992 |
| JP | 63144194 | 10/1988 |
| WO | WO 00/07760 | 2/2000 |

OTHER PUBLICATIONS

XP-002215642, Feb. 28, 1982, Refract Hard Metal.
XP-002215643, Feb. 17, 1975, Klebanov Yu D.

* cited by examiner

*Primary Examiner*—George Wyszomierski
(74) *Attorney, Agent, or Firm*—Blakely, Sokoloff, Taylor & Zafman LLP

(57) ABSTRACT

In the method of producing metals or metal alloys of high purity, in particular metallic chromium, granules of metal containing non-metallic inclusions and a reducing agent are treated under predetermined conditions of temperature and pressure so that the reducing agent reacts on the inclusions. During the treatment, the granules (26) are placed in a crucible (2) having an opening (14), and a wall (4) presenting at least one orifice (24).

17 Claims, 1 Drawing Sheet

REDUCTIVE METHOD FOR PRODUCTION OF METALLIC ELEMENTS SUCH AS CHROME USING A CRUCIBLE WITH A PERFORATED WALL

The present patent application is a non-provisional application of International Application No. PCT/FR03/00165, filed Jan. 20, 2003.

The invention provides a method of reducing metals or metal alloys of high purity, and in particular metallic chromium.

Certain industries require metals and metal alloys of ever increasing purity. This applies in particular to aviation industries for fabricating the noble parts of turbojets.

In document EP-0 102 892, the Applicant discloses a method of producing metals or alloys comprising the steps consisting in:

a) preparing a metal or a metal alloy in which the non-metallic inclusions are essentially oxides of the base metal;

b) grinding the resulting metal or metal alloy and mixing it with a pelletizing agent and a reducing agent to form pellets; and c) subjecting the pellets to a vacuum reducing treatment under conditions of pressure and temperature that are controlled so that the reducing agent reacts on the non-metallic inclusions and so that there is no significant sublimation of the metal or of the alloy metals being treated.

That method can involve, in particular, an aluminothermic reaction in step a), said reaction being unbalanced by a shortage of aluminum relative to the quantity needed for a complete reaction. That method enables high purity metallic chromium to be obtained.

Nevertheless, the relative proportion of some impurities can still be too high for some uses of the metal or the alloy. This applies in particular to the contents of atoms of carbon, nitrogen, and oxygen.

An object of the invention is to further improve the purity of the final product.

To this end, the invention provides a method of producing granules of metal in which granules of metal containing non-metallic inclusions and a reducing agent are treated under predetermined conditions of temperature and pressure so that the agent reduces the inclusions, and in which, during the treatment, the granules are disposed in a crucible having an opening and a wall presenting at least one orifice.

The Applicant has found that the presence of one or more orifices in the crucible improves the purity of the final metal or alloy. This applies in particular for atoms of oxygen and carbon for which it has been possible to reduce the relative concentrations on average by 56% and 70% respectively in the samples that the Applicant has analyzed.

Preferably, the crucible is made for the most part out of graphite, or entirely out of graphite.

Here also, the Applicant has found, surprisingly, that contrary to that which might have been expected, the granules are not polluted by the carbon forming the graphite, and that on the contrary such a crucible enables the purity of the product to be increased.

The method of the invention may also present at least one of the following characteristics:

the wall is a side wall;

a majority of the orifices occupy a bottom half of the wall;

the orifices occupy the bottom two-thirds of the wall;

the orifices are disposed in such a manner that more than half the total area defined by the sum of the areas of the orifices occupies the bottom half of the wall;

the wall is free from orifices over at least a top-fourth of its height from the opening;

the ratio of the total area of the orifice(s) over the total inside volume of the crucible lies in the range 0.5 to 1.5, and preferably in the range 0.80 to 1.20;

the or each orifice has an area lying in the range 50 square millimeters ($mm^2$) to 150 $mm^2$, and preferably in the range 90 $mm^2$ to 130 $mm^2$;

the orifices are mutually identical;

the crucible is of generally constant shape;

the crucible is generally circularly symmetrical in shape;

the crucible is cylindrical in shape;

the treatment is performed under a partial vacuum;

during the treatment, the granules are subjected to an air flow;

the granules are constituted by a metal such as chromium, titanium, vanadium, molybdenum, manganese, niobium, tungsten, and nickel, or an alloy comprising one of those metals and boron or iron;

prior to the treatment, a metallic compound is prepared by means of an aluminothermic reaction between at least one metallic oxide and divided aluminum, and the granules are made from said compound;

prior to treatment, the granules are baked; and the method is implemented to produce metallic chromium.

The invention also provides a crucible for producing metallic granules, the crucible possessing an opening and having a wall presenting at least one orifice.

Other characteristics and advantages of the invention appear further from the following description of a preferred implementation given by way of non-limiting example.

BRIEF DESCRIPTION OF THE DRAWING

In the accompanying drawing, the sole FIGURE is an axial vertical section view of a crucible constituting a preferred embodiment of the invention.

DETAILED DESCRIPTION OF THE INVENTION

Figure 1:
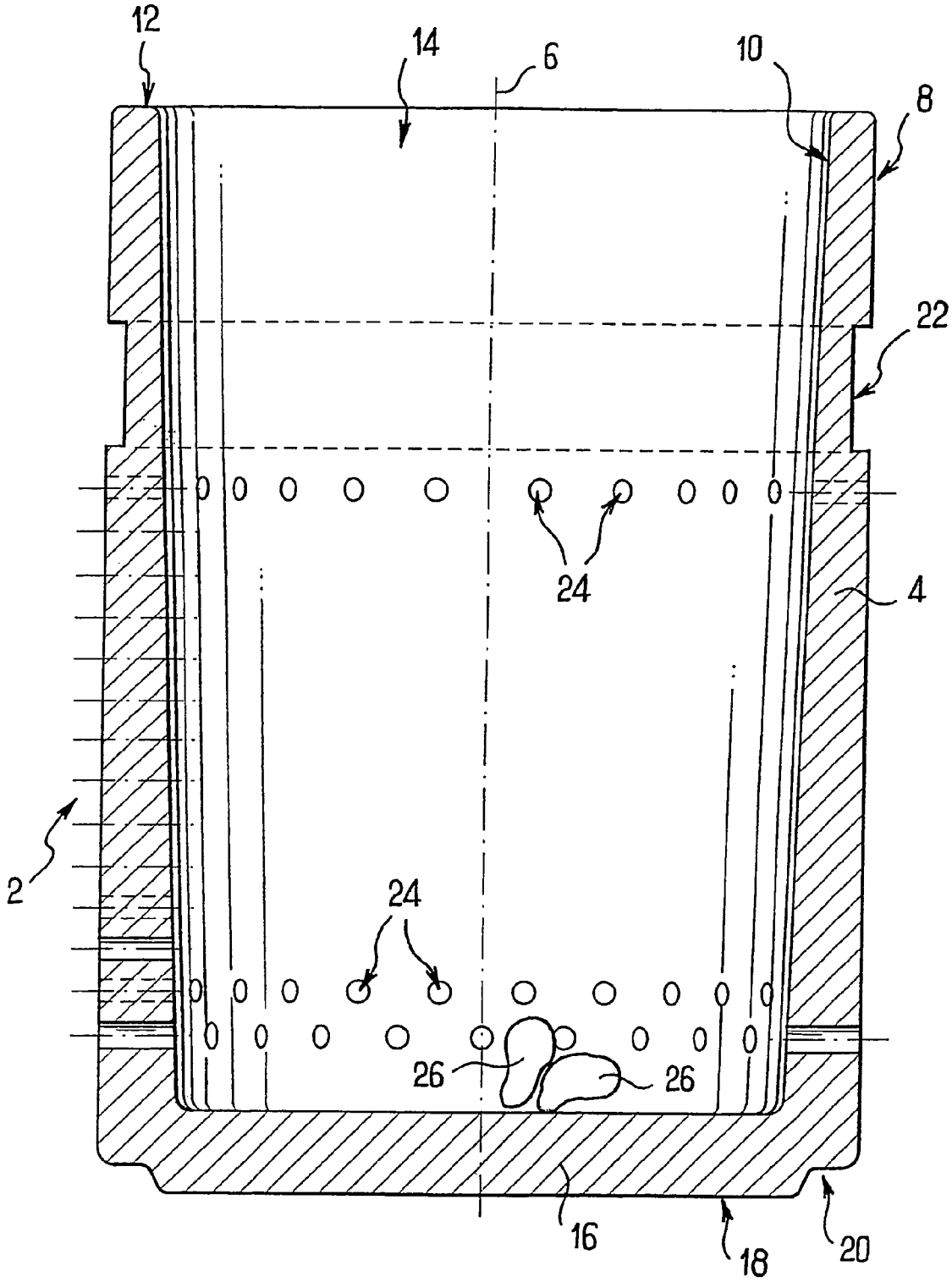

The description begins with the crucible of the invention. Thereafter the method in which the crucible is implemented is described.

The crucible 2 comprises a vertical side wall 4 of generally circular cylindrical shape about an axis 6. The shape of the wall is thus essentially constant along the axis 6, the wall presenting a section that is circular in a plane perpendicular to the axis. The wall 4 presents an outside face 8 that is accurately cylindrical in shape and an inside face 10 that is slightly frustoconical in shape, tapering a little, with the axis 6 constituting the axis of the cone and with the apex of the cone pointing downwards. The diameter of the inside face 10 thus decreases going downwards.

The wall 4 presents a circular top edge 12 of plane shape defining a top opening 14 of the crucible.

The crucible has a flat bottom 16 closing a bottom axial end of the wall remote from the opening 14. At the junction between the outside face 8 of the wall 4 and the bottom face 18 of the bottom 16, the crucible presents a circular shoulder 20 recessed into these two faces and giving the bottom face 18 a diameter that is slightly smaller than that of the opening 14 so as to enable two crucibles to be engaged one in another when they are stacked.

In its top third, the outside face 8 is recessed by a peripheral groove 22 of channel section making the crucible easier to handle with a tool.

The crucible is made of graphite.

The side wall 4 in this example presents a multitude of orifices 24 passing through the thickness of the wall so as to put the inside of the crucible into communication with the outside. Only some of the orifices are shown in FIG. 1. Specifically, the orifices are disposed in a plurality of circular horizontal rows, each row occupying a plane perpendicular to the axis 6. In this example, there are 14 such rows. Each row has 20 orifices uniformly distributed around the circumference of the wall. The rows follow one another, being spaced apart by the same distance. The orifices in successive rows are disposed in a staggered configuration, each orifice of a given row forming an isosceles triangle with the nearest two orifices in the row above and/or the row below. The rows follow one another uniformly. They are disposed in such a manner that the orifices occupy the bottom two-thirds of the height of the wall 4, the top-third adjacent to the opening 14 being completely free from any orifices.

By way of example, the dimensions of the crucible are as follows:

- total height, 516 millimeters (mm);
- height of the crucible from the opening 14 to the inside face of the bottom 16, 476 mm;
- total diameter of the crucible, 360 mm;
- inside diameter of the opening, 313 mm, inside diameter of the bottom, 288 mm;
- outside diameter of the crucible at the bottom of the groove 22, 344 mm;
- the groove 22 is 100 mm from the top edge 12;
- the height of the groove is 60 mm;
- the highest row of orifices is 20 mm below the groove 22, measured to the plane passing through the centers of the orifices.

Using identical references for each row, the rows follow one below another at a spacing of 20 mm. The bottom row is thus about 30 mm from the bottom. Given the thickness of the wall 4, the orifices in this case form ducts, and specifically they have a diameter of 12 mm. The orifices are identical to one another. The area of each orifice is about 113 $mm^2$. Since the number of orifices in this case is 280, the total area of the orifices, i.e. the sum of their individual areas, is about 0.0317 square meters ($m^2$). The total inside volume of the crucible is about 0.336 cubic meters ($m^3$). The ratio of the total area of the orifices over the total volume of the crucible is thus about 0.94 in this case.

There follows a description of how the method of the invention is implemented with the above-described crucible in order to produce metallic chromium.

Step a

Chromium oxide ($Cr_2O_3$), potassium bichromate ($K_2Cr_2O_7$) and divided aluminum are introduced into an ordinary crucible. The chromium oxide and the potassium bichromate are present in proportions appropriate for the aluminothermic reaction. The aluminum is present with a shortage relative to the proportion required for complete reaction. This shortage may lie in the range 0.5% to 8%, or indeed 2% to 5% by weight of the stochiometric quantity.

These three ingredients are mixed and then the reaction is initiated. At the end of the reaction, the metal is collected from the bottom of the crucible. The elemental chromium is reduced and the resulting final product is metallic chromium of high purity identical to the aluminothermic chromium that would have been obtained with a complete reaction, except that it contains a very high oxygen content, which oxygen is almost exclusively present in the form of non-metallic inclusions of $Cr_2O_3$ (0.40% to 0.80% or even more) together with very few alumina inclusions $Al_2O_3$ (100 parts per million (ppm) to 400 ppm, corresponding to 50 ppm to 200 ppm of oxygen bonded with aluminum). Consequently, metallic chromium is obtained with non-metallic inclusions that are constituted mainly by inclusions of $Cr_2O_3$ that can easily be eliminated, and to a minor extent by inclusions of alumina that are more difficult to eliminate, but that are present in smaller quantity.

Step b

The chromium from step a) is ground in an impact grinder so as to obtain a fine powder that passes through the screen with a mesh size of 500 micrometers (μm). The grinder bursts these grains, thereby releasing a good fraction of the non-metallic inclusions of $Al_2O_3$ and $Cr_2O_3$, with the $Cr_2O_3$ inclusions appearing to be released preferentially. This grinding is purifying and produces an air flow. The air flow may also be produced by an auxiliary device such as a blower which contributes to exhausting into ambient air some of the non-metallic inclusions that have been released. A screening step performed at this stage can serve to remove another fraction of the inclusions.

The resulting purified chromium powder is then mixed intimately with a reducing agent and a pelletizing agent. By way of example, the pelletizing agent may be a mixture of Bakelite and an organic binder such as furfuraldehyde. The reducing agent may be constituted by carbon black.

The resulting mixture is formed into pellets or tablets using a conventional compacting press.

After being formed into pellets, the mixture is baked at an appropriate temperature (e.g. 200° C. to 230° C.).

Step c

The resulting pellets 26 are then placed in the crucible 2 and subjected to reducing treatment at 1100° C. to 1400° C. under a vacuum of about $133\times10^{-4}$ pascals (Pa) The crucible is filled with pellets up to its opening.

At the beginning of the vacuum heating cycle, the Bakelite decomposes at a certain temperature, leaving a carbon skeleton which adds to the carbon black that was introduced into the mixture as a reducing agent. Once the treatment temperature has been reached, this carbon reacts with the oxygen of the $Cr_2O_3$ that remains in the material, but reacts hardly at all with the oxygen of the alumina $Al_2O_3$.

The vacuum in the treatment furnace is brought to $133\times10^{-1}$ Pa by controlled sweeping with a non-oxidizing gas or a reducing gas such as hydrogen. To terminate, the product is allowed to cool under an inert atmosphere.

The presence of the orifices appears to have a great influence on the contents of certain impurities, and in particular of oxygen and carbon atoms. The Applicant has undertaken experiments, treating pellets having the same composition in crucibles that are not pierced and in crucibles that are pierced. The contents of atoms of oxygen, of nitrogen, and of carbon were analyzed in the final products, and these contents are summarized in the table below:

| | $O_2$ | C | N |
|---|---|---|---|
| Non-pierced (ppm) | 852 | 450 | 31 |
| Pierced (ppm) | 376 | 135 | 24 |
| Difference (%) | −56 | −70 | −22 |

The impurity contents are given in parts per million (ppm) while the difference is given as a percentage. It can be seen that the presence of orifices enables the content of oxygen atoms to be reduced by about 56% and the content of carbon atoms by about 70%.

It is probable that the presence of the orifices facilitates gas flow through the crucible during treatment, the orifices co-operating with the opening 14 to cause the gas to flow over the full height of the crucible.

It is preferable to provide no orifices in the top portion of the crucible in order to avoid weakening the crucible.

Naturally, numerous modifications can be applied to the invention without going beyond the ambit of the invention.

The crucible presenting orifices may be made out of a material other than graphite. A graphite crucible could be provided that does not have any orifices other than the opening.

The orifices need not be disposed uniformly in the wall. The orifices could be of differing sizes.

Similarly, step a) could be undertaken other than by aluminothermically, for example silicothermically or by reducing in an electric furnace, in order to obtain a metal or a an alloy having non-metallic inclusions in the form of oxides of the base metal.

The invention claimed is:

1. A method of producing granules (26) of metal in which granules of metal containing non-metallic inclusions and a reducing agent are treated under predetermined conditions of temperature and pressure so that the agent reduces the inclusions, the method comprising during the treatment, disposing the granules (26) in a crucible (2) having an opening (14) and a side wall (4) including a plurality of orifices (24) and facilitating a flow of gas through the crucible through the plurality of orifices, wherein the plurality of orifices (24) occupy the bottom two-thirds of the side wall.

2. The method according to claim 1, wherein the orifices are disposed in such a manner that more than half the total area defined by the sum of the areas of the plurality of orifices occupies the bottom half of the side wall (4).

3. The method according to claim 1, wherein the ratio of the total area of the plurality of orifice(s) (24) in square meters over the total inside volume of the crucible in cubic meters lies in the range 0.5 to 1.5.

4. The method according to claim 3, wherein the ratio of the total area of the plurality of orifice(s) (24) in square meters over the total inside volume of the crucible in cubic meters lies in the range 0.80 to 1.20.

5. The method according to claim 1, wherein each of the plurality of orifices (24) has an area lying in the range 50 $mm^2$ to 150 $mm^2$.

6. The method according to claim 5, wherein each of the plurality of orifices (24) has an area lying in the range 90 $mm^2$ to 130 $mm^2$.

7. The method according to claim 1, wherein the plurality of orifices (24) are identical.

8. The method according to claim 1, wherein the crucible (2) is made of graphite.

9. The method according to claim 1, wherein a diameter of the crucible (2) is substantially equal from a top to a bottom of the crucible.

10. The method according to claim 1, wherein the crucible (2) is generally circularly symmetrical in shape.

11. The method according to claim 1, wherein the crucible (2) is cylindrical in shape.

12. The method according to claim 1, wherein the treatment is performed under a partial vacuum.

13. The method according to claim 1, wherein during the treatment, the granules (26) are subjected to an air flow.

14. The method according to claim 1, wherein the granules (26) are constituted by chromium, titanium, vanadium, molybdenum, manganese, niobium, tungsten, and nickel, or an alloy comprising one of those metals and boron or iron.

15. The method according to claim 1, wherein prior to the treatment, a metallic compound is prepared by means of an aluminothermic reaction between at least one metallic oxide and divided aluminum, and the granules are made from said compound.

16. The method according to claim 1, wherein prior to treatment, the granules (26) are baked.

17. The method according to 1, wherein it is implemented to produce metallic chromium.

* * * * *